US006782876B1

(12) United States Patent
Allen

(10) Patent No.: US 6,782,876 B1
(45) Date of Patent: Aug. 31, 2004

(54) REDUCTION OF EMISSIONS OF INTERNAL COMBUSTION ENGINES BY IMPROVING COMBUSTION EFFICIENCY THROUGH EFFECTIVE CONTROL OF ELECTROSTATIC FORCE

(76) Inventor: Robert S. Allen, P.O. Box 4964, Key West, FL (US) 33041

( * ) Notice: Subject to any disclaimer, the term of this patent is extended or adjusted under 35 U.S.C. 154(b) by 0 days.

(21) Appl. No.: 10/350,945

(22) Filed: Jan. 24, 2003

Related U.S. Application Data

(60) Provisional application No. 60/351,171, filed on Jan. 25, 2002.

(51) Int. Cl.[7] ..... F02B 51/00
(52) U.S. Cl. ..... 123/536
(58) Field of Search ..... 123/536, 537, 123/538, 539

(56) References Cited

U.S. PATENT DOCUMENTS 3,963,408 A * 6/1976 Youngberg ..... 431/2
4,183,337 A 1/1980 Maruoka
4,280,467 A 7/1981 Maruoka
4,460,516 A 7/1984 Kapitanov et al.
4,966,121 A * 10/1990 Koga ..... 123/536
5,000,152 A * 3/1991 McCauley ..... 123/536
5,329,910 A 7/1994 Tanaka
5,487,874 A 1/1996 Gibboney
6,178,953 B1 1/2001 Cox
6,178,954 B1 1/2001 Kim
6,306,185 B1 * 10/2001 Berlin et al. ..... 44/321

* cited by examiner

*Primary Examiner*—Marguerite McMahon
(74) *Attorney, Agent, or Firm*—Ronald R. Kilponen

(57) ABSTRACT

A system is shown, which when attached to an internal combustion engine, will charge the air/fuel mixture or fuel mixture and oppositely charge the spark plug such that the air/fuel mixture or fuel mixture will be attracted to the opposite charge of the spark plug in the combustion chamber resulting in fewer exhaust emissions.

34 Claims, 5 Drawing Sheets

Figure 4:
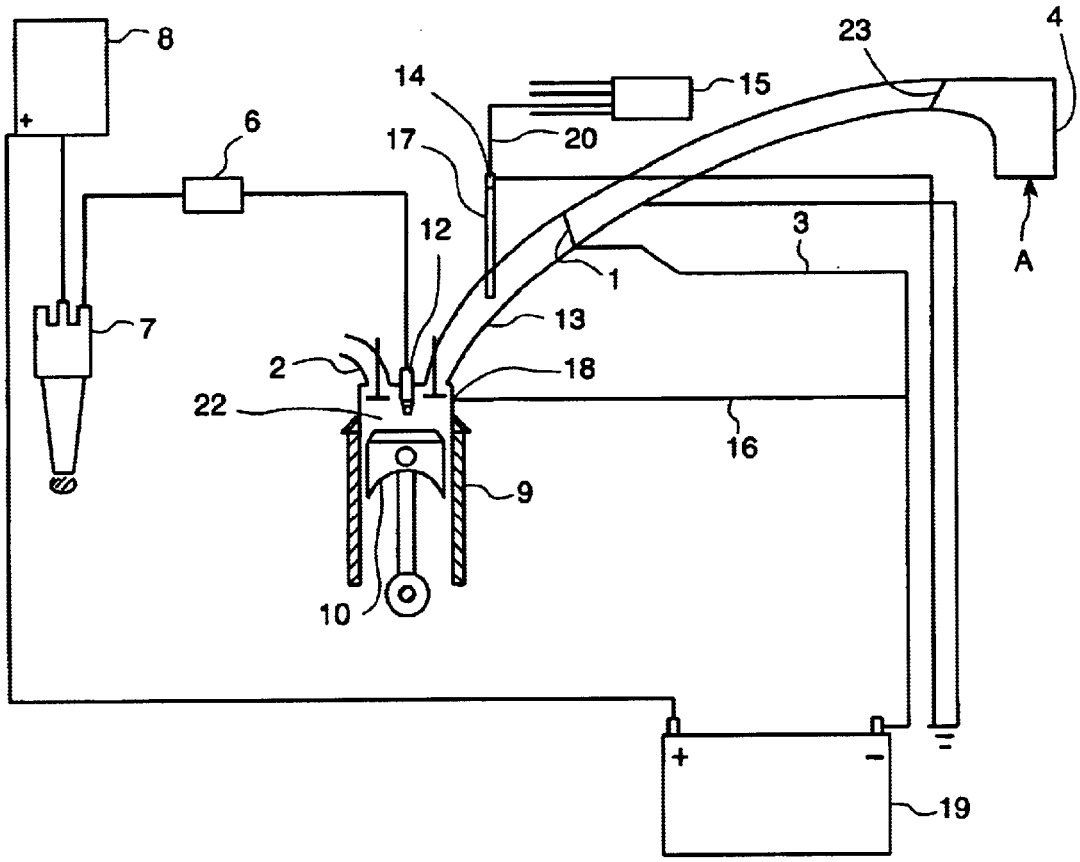

FIG. 4.5
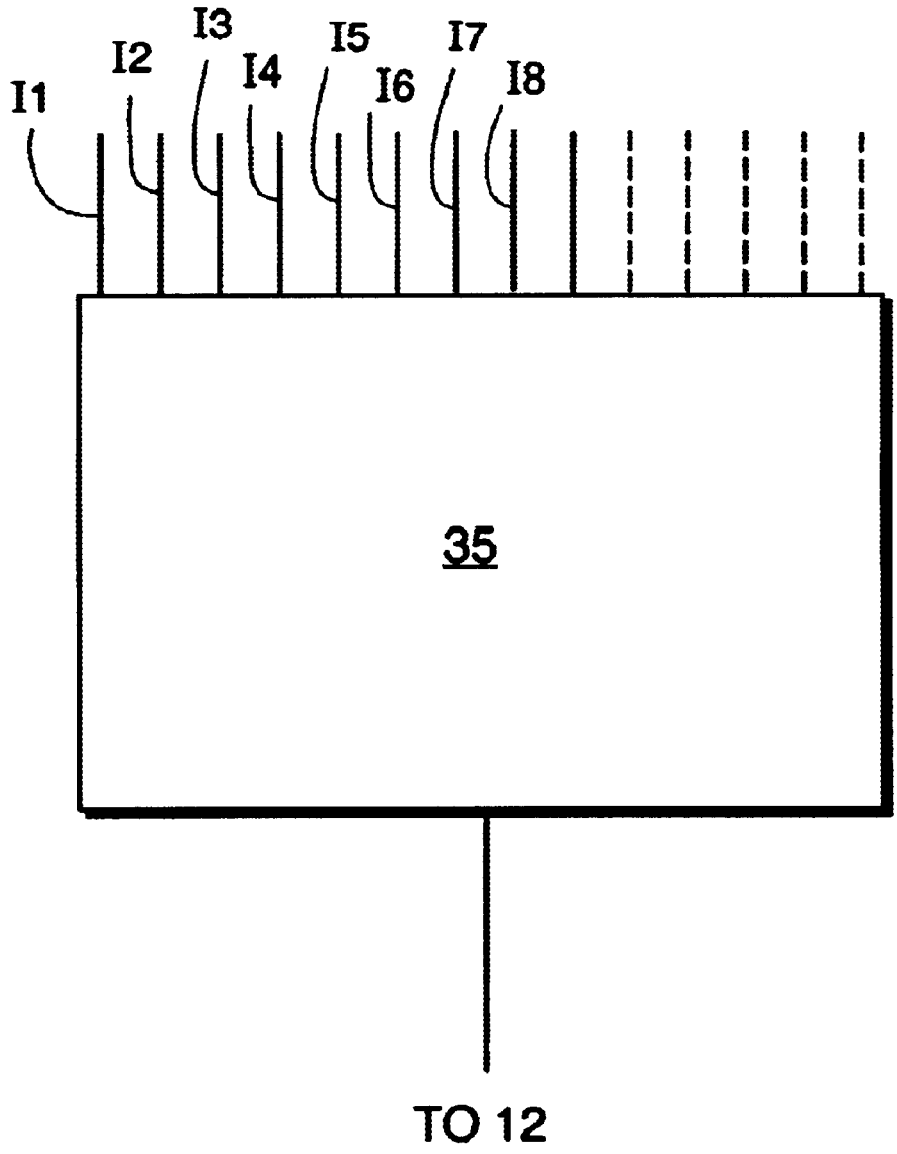

REDUCTION OF EMISSIONS OF INTERNAL COMBUSTION ENGINES BY IMPROVING COMBUSTION EFFICIENCY THROUGH EFFECTIVE CONTROL OF ELECTROSTATIC FORCE

Priority

This application claims the benefit of U.S. Provisional Application No. 60/351,171 filed on Jan. 25, 2002.

FIELD OF THE INVENTION

This present invention relates to the reduction of exhaust gas emissions through the art of effectively controlling the molecular structures of both air and fuel as they exist within the context of internal combustion engines. It is the intent of this invention to place this technology at the fingertips of the consumer so that all may benefit.

BACKGROUND OF THE INVENTION

Internal combustion engines are powered by metered air and fuel quantities. Traditionally, the molecular state of the air and fuel are complex due to both how they exist in nature, as well as the various effects played out by fuel lines and air passageways which can introduce the effects of positive static energy, to name only one such influence. As clusters of complex air and fuel particles enter the combustion chamber and are burned, unwanted exhaust elements such as hydrocarbons, carbon-monoxide and oxides of nitrogen, to name a few, are produced. A great amount of endeaver has been spent on reducing the amount of these gases after they had already been produced; catalytic converters, exhaust gas re-circulation, etc. It is the intent of this invention to reduce the amount of these and other unwanted exhaust gasses by improving combustion efficiency through electrically charging molecular structures of the air and fuel before they enter the combustion chamber and are burned.

Other patents have disclosed similar systems: U.S. Pat. No. 4,280,467 Marouka ('467 patent) discloses a float bowl, a sensor that is located within the combustion chamber, and a means of attracting the fuel into the combustion chamber by influencing the fuel with alternating positive and negative electric charges. The addition of a separate float bowl, as well as a sensor that is located within the cylinder head requires extensive redesign of the fuel system, the cylinder head and, in some cases the piston. Such major retooling of the engine is in direct contradiction to the stated purpose of the invention.

U.S. Pat. No. 5,329,910 Tanaka ('910 patent) discloses concentric rings that loop air and fuel inlets of the engine. These rings contain capacitors and are claimed to reduce concentrations of negative ions of the air and fuel. This art limits the effects of the disclosure to breaking down the molecular structures of air and fuel prior to entry into the combustion chamber. This affect creates a lean air/fuel mixture that can cause serious engine damage.

The means disclosed by the present invention have been proven through tests to be very effective. In tests, rates of carbon monoxide are at levels that are below one percent and hydrocarbon levels registered at 30–35 ppm.

If all are to benefit from this technology, it must be presented in a manner that can be applied to many different types of engines. It must also be simple in design so that anyone with ordinary mechanical skills may apply it.

The present embodiment of the invention is the most effective example of the art. The present disclosure is the only existing application that re-formulates the lean air/fuel mixture or fuel mixture and concentrates it near the spark plug electrode via the spark plug electrode itself.

SUMMARY OF THE INVENTION

The intended use of this present invention is to lower the amount of harmful exhaust emissions such as carbon monoxide, hydro carbons, oxides of nitrogen, etc. of internal combustion engines of types found in cars, trucks, motor cycles, vessels, weed eaters, mopeds and the like. Likewise, it is the intent of this invention to reduce the emissions with a relatively low cost method that can be installed and maintained by anyone with competent mechanical skills. Once installed, the separate entities of the invention work in unison to control the air/fuel mixture while simultaneously reducing the amount of noxious exhaust emissions. The first application of preferred embodiments to be discussed relates to engines which have carburetors.

1. An electrically insulated screen is placed between the point of fuel dispersion and the cylinder head. This screen is then connected to a negative energy source. The act of forcing air/fuel mixture or air through an electrically charged screen contributes to the art by creating a more thoroughly charged mixture. Prior art either wraps the outside of the intake passages with capacitors or relies on a separate float bowl in a similar attempt, but with obvious limitations and therefore less predictable results.

2. The intake manifold and cylinder head are each electrically insulated and can be connected to a negative pole of an energy source or power supply. This prevents the air/fuel mixture from clinging to inner surfaces of the intake manifold and cylinder head. Although it is well known in the art that an electrically charged air or fuel mixture will become attached to inner surfaces of said engine parts, prior art has either omitted this from the design, or has failed to effectively control this vital function. The '467 patent, allows the electrically charged air/fuel mixture to cling to the surfaces of the intake and engine when the mixture becomes positively charged.

3. A PED (Positive Energy Device) is electrically insulated and located between the spark plug and the ignition power source. As air and fuel pass through the screen, the various negative ion clusters become dispersed through an electrostatic force. As the complex molecular forms of the mixture are broken down into simple structures, the air/fuel mixture becomes lean. The PED creates a positive, low voltage pulse that attracts the negatively charged lean air/fuel mixture or air and fuel to an area near the spark plug electrode. A normal, or relatively non-lean mixture, is therefore created from an otherwise lean mixture. The richened mixture ignites during the normal spark cycle and the function of the engine resumes while simultaneously producing fewer harmful emissions.

The present invention is an improvement over prior art by placing a PED between the spark plug and the ignition power source and a screen to charge the air/fuel mixture. In doing so, the spark plug electrode becomes the sensor that attracts the lean air/fuel mixture. There is no need for a separate sensor to be added to the combustion chamber.

Some art places a separate sensor within the vicinity of the spark plug in order to attract the lean mixture to the spark plug electrode area. Locating a separate sensor within the combustion chamber affects the flow of air and fuel as they enter the combustion chamber. Also, adding a separate sensor to an already complex and sophisticated structure as a cylinder head requires expensive redesign that must be performed by the manufacturer, or at great cost to the consumer.

For applications which use fuel injection, where fuel is injected into the cylinder head or throttle body, an alternative, embodiment exists.

1. A screen is placed between the engine air inlet and the cylinder head. This screen is electrically insulated and connected to a negative energy source or power supply. As air passes through the screen, the air density increases and produces an oxygen enriched air charge. Also, the atomic molecules of the air, which normally cling together in the natural state, become dispersed through electrostatic force.

2. The air inlet manifold and cylinder head are both electrically insulated and connected to a negative energy source or power supply so that the electrically charged air does not cling to the inner surfaces of the intake manifold and cylinder head. If the intake and other surfaces were made of materials that were not capable of holding or obtaining an electrical charge, the connections to the negative energy source would not be needed as the air or air/fuel mixture would not adhere to these surfaces.

3. An electrically insulated sensor is located within the fuel injection delivery line and is connected to the negative energy source. The sensor electrically charges the fuel prior to entry into the cylinder head or throttle body. This is an improvement over prior art. Prior art requires a separate float bowl in which the sensor resides. Such a design cannot be fitted without either extensive re-engineering by the manufacturer, or significant costs to the consumer. The present invention requires replacing the fuel lines with a fuel line that retains the sensor. This is a simple, more cost effective application than the prior art.

4. A PED (Positive Energy Device) is located between the distributor or ignition power source and spark plug. The PED emits a low voltage pulse that attracts the electrostatically charged mixture of air and fuel near the spark plug electrode in order to richen the mixture at the point of ignition.

The PED is connected within the ignition circuit via the spark plug wire. The connection of the PED to the spark plug wire is by universal connectors commonly known in the art. This design allows the low voltage pulse to be tailored to the requirements of each individual cylinder. This simple design makes controlling this vital entity similar to changing a spark plug. Also, the simplicity of the PED, like the screen and the fuel line and sensor allow it to be obtained at the local automotive parts store and installed by most consumers.

5. The spark plug ignites the richened mixture during the normal spark cycle and the normal function and cycling of the engine resumes while continuing to produce fewer exhaust emissions.

An additional benefit to this invention may be an increased fuel economy. Although this result was not specifically tested for, common sense would dictate that because the air/fuel mixture is leaner, less total fuel would be used for the same amount of work output.

These objects, together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment of this version of the invention.

DETAILED DESCRIPTION OF THE PREFERRED EMBODIMENTS

The following description of preferred embodiments relate to application of this present invention to overhead valve, four-stroke engines. However, applications to other types of engines such as: two-stroke, side-valve, diesel and others shall be made apparent to those skilled in the art without altering the design entities which this present invention correlates. Therefore, application of this present invention shall not be limited by interpretation of the enclosed preferred embodiments, only by literal interpretation of claims set forth herein.

Figure 1:
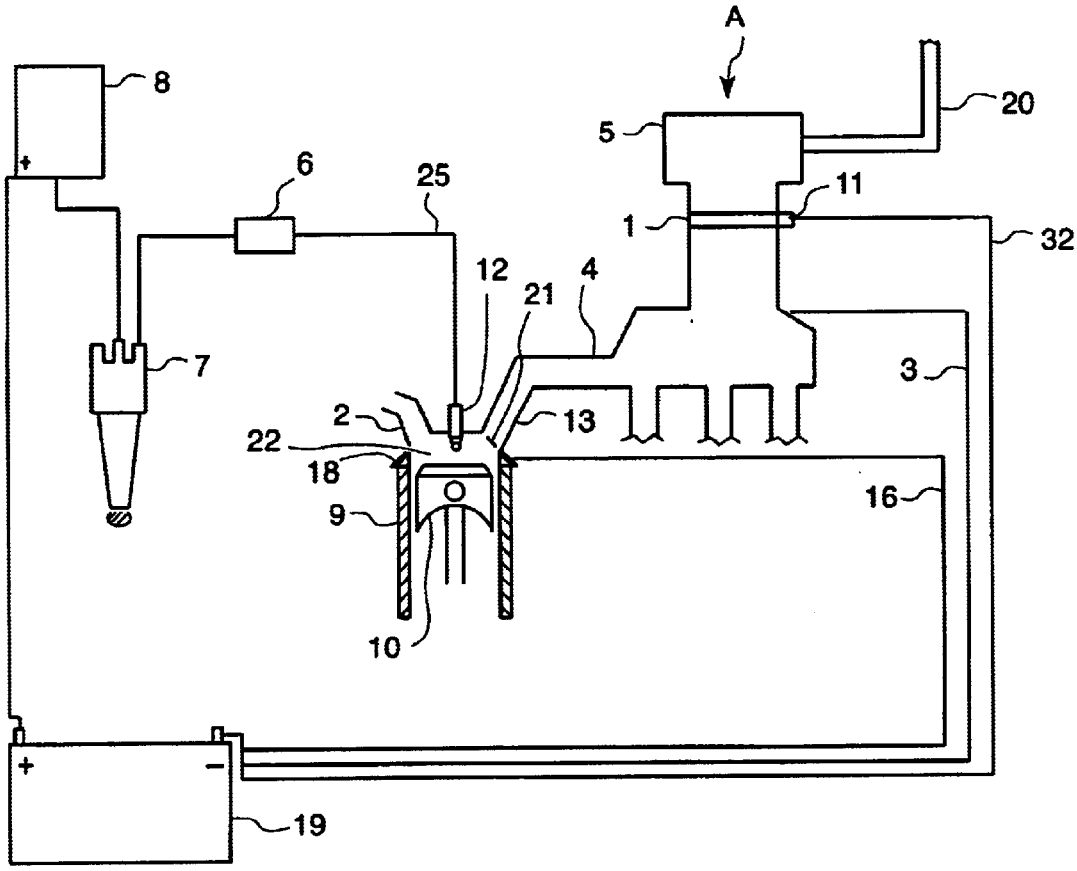

FIG. 1 shows a depiction of an engine equipped with a traditional carburetor 5, fuel system. Air A, enters the engine through the carburetor 5, where it then passes through the screen 1, located in this embodiment at the base of the carburetor 5, and above the intake manifold 4.

Figure 2:
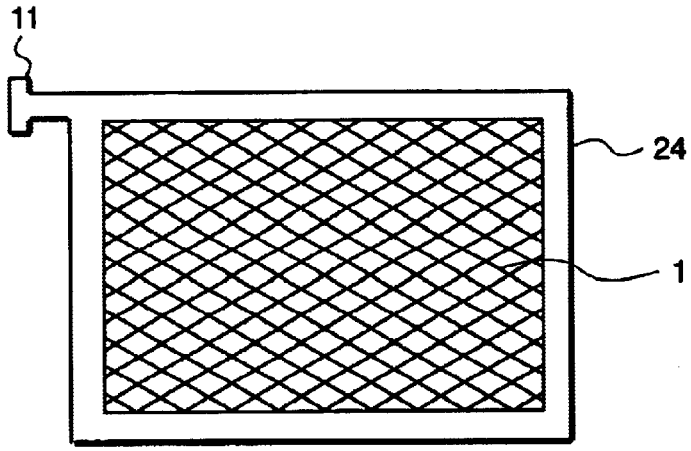

FIG. 2 shows a depiction of one embodiment of a screen 1 having a connection 11. The screen 1, must not interfere with the mechanical operation of the carburetor 5. Although it is best to locate screen 1, closest to the carburetor 5, it may also be located closest to the cylinder head 18, or anywhere in between. Although the screen 1, may theoretically consist of any common combination of metals or materials normally used to conduct and transmit electrical current, a type of metal with a content largely composed of copper is a preferred embodiment. In another embodiment, the screen 1 could be manufactured from any of the noble metals or other mixtures or alloys as long as they are electrically conductive. The gauge of metal wire that is preferred, as well as the size of area between each wire must be of a type that provides greatest electrostatic affect while at the same time provides the least amount of physical resistance to the volume of air and fuel passing through the screen 1. The screen 1, is connected to a gasket material 24. The gasket material 24, shall be of a type that isolates both heat and insulates against electrical current in order that exposure to such affects does not limit effectiveness of screen 1. The connection 11 is connected to the screen connection 32 which in turn connects the screen 1 to the negative pole of the energy source 19.

Both intake manifold 4, and cylinder head 18, are connected to the negative pole of the energy source 19, via connections 3, 16, respectively, so that electrostatically charged air and fuel does not cling to the inner surfaces of these components, FIG. 1. These elements, if not made from electrically non-conductive materials, would need to be electrically insulated.

As air mixes with fuel in the carburetor 5, and then passes through the screen 1, both the air and fuel become electrostatically charged. The mixture is then drawn through the intake manifold 4, in through the intake port 13, by downward movement of the piston 10.

Figure 3:
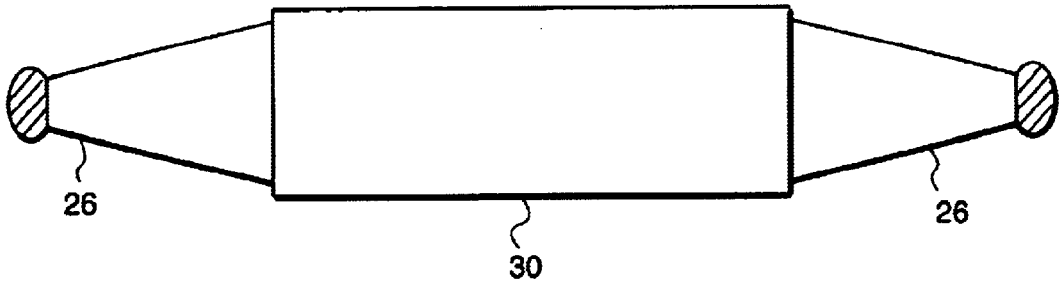

FIG. 3 shows one embodiment of a PED (Positive Energy Device) 6. The PED 6, emits a low voltage pulse that attracts the electrostatically charged air/fuel mixture through the intake port 13, past the intake valve 21, to the vicinity of the spark plug electrode 12, which resides within the combustion chamber 22, FIG. 1. The PED 6, consists of electrical circuits that store, reduce and emit electrical current. These electrical circuits that exist within the PED 6, may be similar to a capacitor. The voltage capacity of the PED 6, must not be exceeded by the voltage capacity of the ignition power source 8. The electrical current passing through the PED 6, is controlled by parameters: one parameter allows electric current to be stored; one parameter allows electrical current to be reduced; one parameter allows electrical current to be emitted; one parameter allows electrical current to pass through the circuits of the PED 6, in a state that is relatively unaltered. Both the rate by which the electrical current is to be reduced, as well as the rate at which the electrical current is to be emitted must be decided and applied by those skilled in the art.

For best results, it is required that the current emitted during the pulse mode of the PED 6, not ignite the applicable fuel mixture in the combustion chamber 22. It is also required that the current emitted in pulse mode is within the parameter of the non-spark cycle. In the interest of economy, parameters of the PED 6, that control electrical activity may be in a state that is pre-determined. However, some applications may require that some parameters of the PED 6, be independently adjustable. Applications in which the fine tuning of the PED 6, is desirable may require additional electrical circuitry that allows for the fine tuning of parameters or adjustment means of the PED 6. These adjustments means may require physical changes, or adjustment devices, to the PED 6, such as adjustment screws, slides, or similar. Alternatively, these adjustments may be made through the implementation and operation of control software, which would read certain inputs and adjust the output of the PED 6 accordingly. The controller 35 can read various inputs and combination of inputs such as I1–I8 which could read engine rpm, load, fuel quality, temperature and other factors normally monitored in engine operation. The number of inputs is only limited by the capacity of the controller, FIG. 4. Once these inputs are read by the controller, a software program or algorithm can be run using these inputs to control the voltage and duration of the signal sent to the spark plug 12 for drawing the air/fuel mixture or air and fuel into the combustion chamber 22.

These adjustment devices, or adjustment means, cannot adversely effect the physical limitations of PED 6, because of exposure to heat, moisture and other harmful elements that are known to exist in the vicinity of engines.

The electrical circuits of the PED 6, shall be enclosed in a case 30, that consists of a non-conductive material and a substance that protects the circuits from effects of heat, moisture, physical shock, exterior electrical influences and other harmful elements commonly found near engines. Both electrical circuits and casing 30, shall be of a physical size that fully economizes the use of space. The PED 6, shall be connected to the spark plug wire 25, by terminals 26. The terminals 26, consist of a type that use connectors that are commonly found in the market.

The enriched air/fuel mixture burns within the combustion chamber 22, during the normal combustion cycle and the piston 10, moves downward. Once the air/fuel mixture is burned, the exhaust gases exit through the exhaust port and the combustion cycle begins again.

FIG. 4 shows a depiction of an engine equipped with a traditional fuel injection type induction. Air A, enters the engine through the intake manifold 4, where it passes through the screen 1, and becomes electrostatically charged. The screen 1, must not physically interfere with the mechanical operation of the air intake mechanism 23. Although the screen 1, may be located near the air intake mechanism 23, as in this embodiment, it may also be located nearer the cylinder head 18.

Both intake manifold 4, and cylinder head 18, are electrically insulated and connected to the negative pole of energy source 19, via manifold connection 3, and cylinder head connection 16, respectively, so that electrically charged air and air/fuel does not cling to the inner surfaces of the intake manifold 4, or cylinder head 18.

FIG. 4 shows a depiction of a sensor 14, in a fuel line 20. The fuel line 20, with sensor 14, consists of material compatible with those used to deliver fuel from the fuel distribution point 15, to the cylinder head 18.

Figure 5:
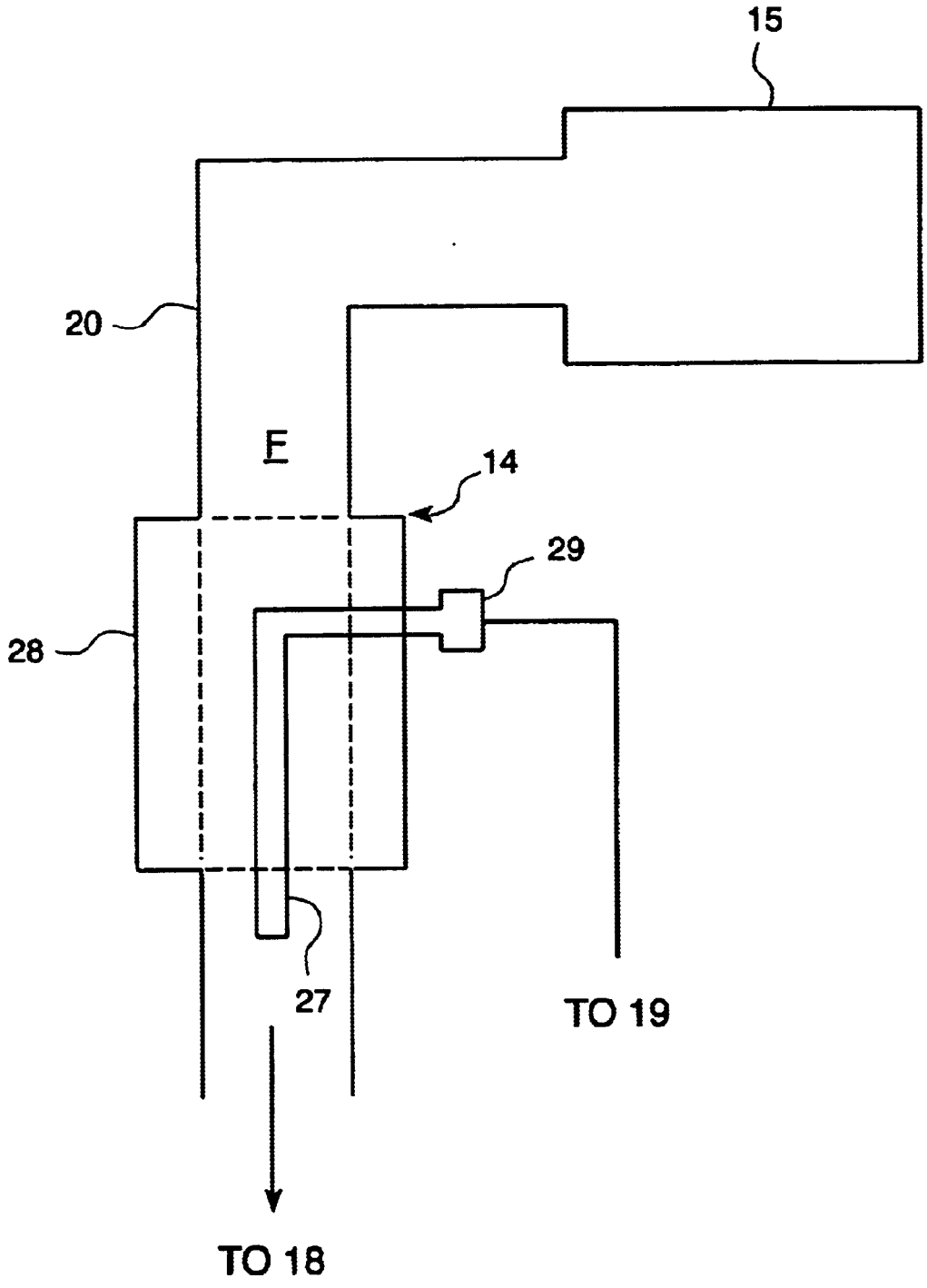

FIG. 5 shows a sensor 14, having an electrode 27, which is made from a material that is known to conduct and transmit electrical current.

The diameter of the electrode 27, is such that fuel F, surrounding the electrode 27, becomes electrostatically dispersed. The diameter of the electrode 27, must not inhibit the expected flow of fuel F, into the cylinder head 18, FIG. IV. The electrode 27, is attached to a casing 28.

The casing 28, is composed of a material that electrically insulates the electrode 27, and prevents the effects of static electricity. The casing 28, is composed of a material that does not conduct electrical current and has an electrical fitting 29, that is attached to one end of the electrode 27.

The casing 28, fuel line 20, fittings and electrode 27, are each capable of withstanding fluid pressures normally associated with fuel injection systems known in the art. The casing 28, locates the electrode 27, at a point near the cylinder head 18, without physically and electronically influencing other separate entities that exist within the fuel line 20, and related engine systems; for example: fuel injectors 17.

The fuel line 20, and casing 28, are made from a material that electronically isolates the function of the electrode 27, from external electronic influences normally associated with internal combustion engines such as ignition systems, radio waves, microwaves etc. The terminal 29, of the fuel line sensor 14, which is connected to a negative pole of energy source 19, charges the fuel prior to entry into the cylinder head 18. The molecular structure of the fuel thus becomes electrostatically dispersed.

The system then functions as the prior embodiments where the PED 6, emits a low-voltage pulse that attracts both electrically charged air and fuel to an area near the spark plug electrode 12, which resides inside the combustion chamber 22. The air and fuel mixture becomes enriched in the area surrounding the charge of spark plug 12, from the charge of the PED 6. The enriched air and fuel mixture ignites during the normal combustion cycle and the piston 10, moves downward in the cylinder 9, and thus continues in the engine cycle commonly known in the art and the prior embodiments. While the prior embodiments specifically discuss charging the screen 1, intake manifold 4, carburetor 5 and combustion chamber 22 negatively and the spark plug 12 positively, it should be understood that the inverse could also be operational, in that the spark plug 12 could be negatively charged and the other elements positively charged.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A system to decrease the amount of emissions from an internal combustion engine, the system comprising:

an electrically insulated screen located in the air/fuel stream between the carburetor and cylinder head, the screen connected to the negative pole of the energy source;

a PED interconnected between the ignition power source and spark plug for charging the spark plug positively, the PED connected to the positive pole of the energy source;

at least one connection between the negative pole of the energy source and the electrically insulated intake manifold and cylinder head and screen; and whereby, the screen charges the air/fuel mixture to a negative state and the air/fuel mixture is not attracted by the connection of the negative pole of the energy source to the intake manifold and cylinder head but is attracted to the positive charge of the spark plug from the PED causing a predetermined concentration of the air/fuel mixture at the spark plug for combustion.

2. The system of claim 1, wherein:

the screen is made from a copper alloy.

3. The system of claim 1, wherein:

the PED is a capacitor.

4. The system of claim 1, further comprising:

a first connection from the negative pole of the energy source to the intake manifold, a second connection from the negative pole of the energy source to the cylinder head and a third connection form the negative pole of the energy source to the carburetor.

5. The system of claim 1, wherein:

the charge of the PED is reversed and the charge of the screen, intake manifold, and combustion chamber are also reversed.

6. The system of claim 1 further comprising a controller interconnected to the spark plug and energy source for receiving input and optimizing the charge in the spark plug in relation to the input factors and the cycling of the engine.

7. A system to decrease the amount of emissions from an internal combustion engine, the engine having a carburetor, ignition power source, intake manifold, cylinder head, combustion chamber, spark plug, energy source and fuel line, the system comprising:

an electrically insulated screen located between the carburetor and the cylinder head, the screen for charging the air/fuel mixture to a first charged state;

a PED located between the ignition power source and the spark plug for charging the spark plug to a second charged state opposite that of the first charged state;

at least one connection between the energy source and the electrically insulated intake manifold, combustion chamber and carburetor for charging to the first charged state; and whereby, the screen having the first charged state charges the air/fuel mixture, the air/fuel mixture is repelled by the first charged state of the intake manifold and combustion chamber and the air/fuel mixture is drawn into the combustion chamber by the attraction to the second charged state of the spark plug caused by the PED where combustion of the air/fuel mixture occurs near the spark plug.

8. The system of claim 7, wherein:

the screen is made from a copper alloy.

9. The system of claim 7, wherein:

the PED is a capacitor.

10. The system of claim 7, wherein:

the charge of the PED is reversed and the charge of the mesh screen, intake manifold, combustion chamber and carburetor are also reversed.

11. The system of claim 7 further comprising:

a controller interconnected to the spark plug and energy source for receiving input and optimizing the charge in the spark plug in relation to the input factors and the cycling of the engine.

12. A system for decreasing the amount of emissions from an internal combustion engine, the engine having a carburetor, fuel line, intake manifold, cylinder head, combustion chamber, spark plug and energy source with a positive and negative pole, the system comprising:

a mesh screen made from an electrically conductive material surrounded by a gasket of non-conductive material, the screen for placement between the carburetor and cylinder head, a connection for interconnecting the screen to a negative pole of the energy source for energizing the screen to a predetermined level such that the screen thoroughly charges the passing air/fuel mixture to a predetermined level;

a positive energy device for placement between the ignition power source and the spark plug, the positive energy device for charging the spark plug to a predetermined positive level such that the spark plug attracts the air/fuel mixture;

a connection between the energy source and the electrically insulated intake manifold, combustion chamber and carburetor providing a charge the same as the charge of the screen; and whereby the charge to the intake manifold and combustion chamber repel the air/fuel mixture and the positive energy device creates an opposite charge in the spark plug thereby drawing and attracting the air/fuel mixture to a location near the spark plug for combustion.

13. The system of claim 12, wherein:

the screen is made from a copper alloy.

14. The system of claim 12, wherein:

the positive energy device is a capacitor.

15. The system of claim 12, wherein:

there is a first connection from the energy source to the intake manifold, a second connection from the energy source to the combustion chamber and a third connection form the energy source to the carburetor.

16. The system of claim 12, wherein:

the charge of the positive energy device is reversed and the charge of the mesh screen, intake manifold, combustion chamber and carburetor are also reversed.

17. The system of claim 12 further comprising a controller interconnected to the spark plug and energy source for receiving input and optimizing the charge in the spark plug in relation to the input factors and the cycling of the engine.

18. A system for modifying an internal combustion engine to decrease the amounts of emissions from the exhaust, the system comprising:

an electrically insulated mesh screen for placement between the carburetor and combustion chamber, the screen for electrically charging the air/fuel mixture to a predetermined level, the screen charged by one pole of an electrical source;

a PED for charging the spark plug to an electrical state opposite that of the air/fuel mixture;

a plurality of electrical connections between the electrical source and an electrically insulated intake manifold, combustion chamber and carburetor for charging to a state opposite that of the spark plug; and whereby, the air/fuel mixture passing through the mesh screen causes a charge to be obtained by the air/fuel mixture, the connections cause the same polarity charge to the intake manifold and combustion chamber thereby repelling the air/fuel mixture and the PED creates an opposite charge in the spark plug thereby drawing and attracting the air/fuel mixture to a location near the spark plug for combustion.

19. The system of claim 18, wherein:

the mesh screen is made from a copper alloy.

20. The system of claim 18, wherein:

the PED is a capacitor.

21. The system of claim 18, wherein:

there is a first connection from the energy source to the intake manifold, a second connection from the energy source to the combustion chamber and a third connection form the energy source to the carburetor.

22. The system of claim 18, wherein:

the charge of the PED is reversed and the charge of the mesh screen, intake manifold, combustion chamber and carburetor are also reversed.

23. The system of claim 18 further comprising a controller interconnected to the spark plug and energy source for receiving input and optimizing the charge in the spark plug in relation to the input factors and the cycling of the engine.

24. A system to decrease the amount of emissions from an internal combustion engine, the system comprising:

an electrically insulated screen located in the air stream between the air inlet and cylinder head, the screen connected to the negative pole of the energy source;

a casing housing an electrode with a terminal, the casing located in the fuel line between the fuel injection distribution block and the cylinder head, the electrode connected to the negative pole of the energy source;

a PED interconnected between the ignition power source and spark plug for charging the spark plug positively, the PED connected to the positive pole of the energy source;

at least one connection between the negative pole of the energy source and the electrically insulated intake manifold arid cylinder head and casing; and whereby, the screen charges the air mixture to a negative state and the air mixture is not attracted by the connection of the negative pole of the energy source to the intake manifold and cylinder head but is attracted to the positive charge of the spark plug from the PED causing a predetermined concentration of the air and fuel mixture at the spark plug for combustion.

25. The system of claim 24, wherein:

the electrode is made from a copper alloy.

26. The system of claim 24, wherein:

the PED is a capacitor.

27. The system of claim 24, further comprising:

a first connection from the negative pole of the energy source to the intake manifold, a second connection from the negative pole of the energy source to the cylinder head and a third connection form the negative pole of the energy source to the fuel injection distribution block.

28. The system of claim 24 further comprising a controller interconnected to the spark plug and energy source for receiving input and optimizing the charge in the spark plug in relation to the input factors and the cycling of the engine.

29. A system for decreasing the amount of emissions from an internal combustion engine, the engine having a fuel injection distribution block, fuel line, intake manifold, cylinder head, combustion chamber, spark plug and energy source with a positive and negative pole, the system comprising:

a mesh screen made from an electrically conductive material surrounded by a gasket of non-conductive material, the screen for placement between the air intake and cylinder head, a connection for interconnecting the screen to a negative pole of the energy source for energizing the screen to a predetermined level such that the screen thoroughly charges the passing air to a predetermined level;

casing housing an electrode having a terminal for attachment to the negative pole of the energy source for energizing the electrode to a predetermined level such that the electrode thoroughly charges the passing fuel to a predetermined level;

a positive energy device for placement between the ignition power source and the spark plug, the positive energy device for charging the spark plug to a predetermined positive level such that the spark plug attracts the air and fuel mixture;

a connection between the energy source and the electrically insulated intake manifold, combustion chamber and fuel injection distribution block providing a charge the same as the charge of the electrode; and whereby the charge to the intake manifold and combustion chamber repel the air and fuel mixture and the positive energy device creates an opposite charge in the spark plug thereby drawing and attracting the air and fuel mixture to a location near the spark plug for combustion.

30. The system of claim 29, wherein:

the electrode is made from a copper alloy.

31. The system of claim 29, wherein:

the positive energy device is a capacitor.

32. The system of claim 29, wherein:

there is a first connection from the energy source to the intake manifold, a second connection from the energy source to the combustion chamber and a third connection form the energy source to the fuel injection distribution block.

33. The system of claim 29, wherein:

the charge of the positive energy device is reversed and the charge of the electrode, intake manifold, combustion chamber and fuel injection distribution block are also reversed.

34. The system of claim 29 further comprising a controller interconnected to the spark plug and energy source for receiving input and optimizing the charge in the spark plug in relation to the input factors and the cycling of the engine.

* * * * *